US005823040A

United States Patent [19]

Stodd

[11] Patent Number: 5,823,040

[45] Date of Patent: Oct. 20, 1998

[54] METHOD AND APPARATUS FOR FORMING A CAN SHELL

[76] Inventor: Ralph P. Stodd, 6450 Poe Ave. Suite 213, Dayton, Ohio 45414

[21] Appl. No.: 850,826

[22] Filed: May 2, 1997

[51] Int. Cl.[6] ..... B21D 51/44

[52] U.S. Cl. ..... 72/329; 72/348

[58] Field of Search ..... 72/329, 336, 348, 72/351; 220/623, 624

[56] References Cited

U.S. PATENT DOCUMENTS 798,530 8/1905 Rehfuss et al. ..... 72/351

4,467,933 8/1984 Wilkinson et al. ..... 220/623

5,381,683 1/1995 Cowling .

*Primary Examiner*—Lowell A. Larson

*Attorney, Agent, or Firm*—Jacox, Meckstroth & Jenkins

[57] ABSTRACT

A food can end or shell is formed from a thin metal sheet by blanking a circular disk from the sheet, gripping a peripheral portion of the disk, pressing a center portion of the disk upwardly relative to the peripheral portion, and forming upwardly projecting concentric beads within an annular portion of the disk. Thereafter, an annular chuck wall, countersink and crown portion are formed within the disk around the concentric beads. A downwardly projecting annular bead is formed within the bottom wall of the countersink and cooperates to resist buckling of the shell.

10 Claims, 5 Drawing Sheets

METHOD AND APPARATUS FOR FORMING A CAN SHELL

BACKGROUND OF THE INVENTION

In the production of either two-piece or three-piece metal cans or containers, especially those for enclosing food products, it is common to produce the can ends or shells from thin sheet metal such as coated steel having a gage or thickness of about 0.008 inch. The can ends or shells are also commonly produced with tooling mounted in a high-speed mechanical press for producing a plurality of shells with each stroke of the press. Usually, the tooling will produce over ten shells with each press stroke.

A typical circular can end or shell for a food product container is disclosed in U.S. Pat. No. 5,381,683 and includes a center panel surrounded by an annular bead or countersink having a U-shaped cross-section and which connects the center panel to a tapered annular chuck wall. The chuck wall extends upwardly to a surrounding seaming or crown portion which is later seamed to the cylindrical sheet metal sidewall of the container. The center panel is formed with a series of concentric ribs or beads which cooperate with the countersink and chuck wall to strengthen the shell and prevent buckling of the shell when the container is pressurized during processing of the food product. The concentric reinforcement beads, as shown in above-mentioned U.S. Pat. No. 5,381,683, are completely formed within the center panel at the bottom of the press stroke and after the crown and chuck wall portions are formed, as shown in FIGS. 6–8 of the Patent.

SUMMARY OF THE INVENTION

The present invention is directed to an improved method and apparatus for producing a container end wall or can shell from a flat metal sheet and which provides for significantly reducing the gage or thickness of the sheet, for example, from 0.008 inch to 0.006 inch, while providing for the same or increased buckle strength, thereby significantly reducing the overall cost of the container.

In accordance with a preferred embodiment of the invention, a container end wall or shell is formed with tooling similar to the tooling disclosed in U.S. Pat. No. 5,042,284, the disclosure of which is hereby incorporated by reference. After first blanking a disk from a metal sheet, the tooling of the present invention grips a peripheral portion of the disk between an annular blanking die and an opposing annular pressure sleeve. A series of concentric beads are then formed within a center portion of the disk and while the center portion is connected to the peripheral portion by an inverted tapered intermediate wall portion. After the concentric beads are formed, the center portion of the disk is moved axially or downwardly to form an annular countersink with a bottom wall, a crown portion and a tapered chuck wall portion connecting the crown portion to the countersink portion. By first forming the concentric beads within the center portion of the disk, thinning of the sheet metal forming the beads is minimized so that maximum reinforcement is obtained from the beads. The method and the apparatus of the invention also forms another annular bead which projects inwardly or downwardly from the bottom wall of the countersink and which cooperates with the other concentric beads to obtain maximum buckle strength for a shell of minimum gage.

Other features and advantages of the invention will be apparent from the following description, the accompanying drawings and the appended claims.

DESCRIPTION OF THE PREFERRED EMBODIMENT

Figure 2:
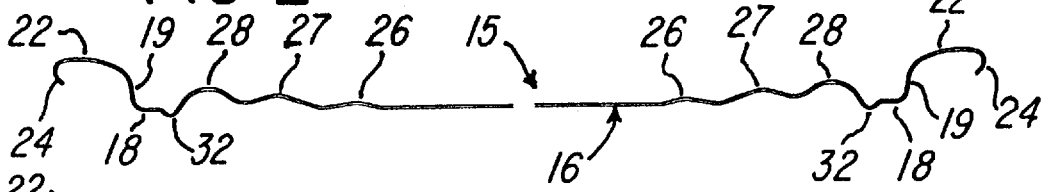
FIG. 2 is a slightly enlarged section of a can end wall or shell constructed in accordance with the invention.

Referring to the drawings, FIG. 2 shows a cross-section of a can end or shell 15 formed in accordance with the invention from sheet metal such as coated steel and which is ideally suited for use on one end or both ends of a cylindrical sheet metal food can or container. That is, the shell 15 may be used on the top end of a two-piece container and on both the top and bottom ends of a three-piece container. As shown on FIGS. 2 and 3, the circular shell 15 includes a center panel portion 16 having a surrounding inclined panel wall 17. The panel wall is connected by a countersink wall 18 to a slightly tapered chuck wall 19 from which extends to a crown portion 22 having a downwardly projecting lip 24. The return lip 24 is shown after being formed inwardly with a curling unit as disclosed in U.S. Pat. No. 5,491,995 issued to the inventor of the present application.

Figure 3:
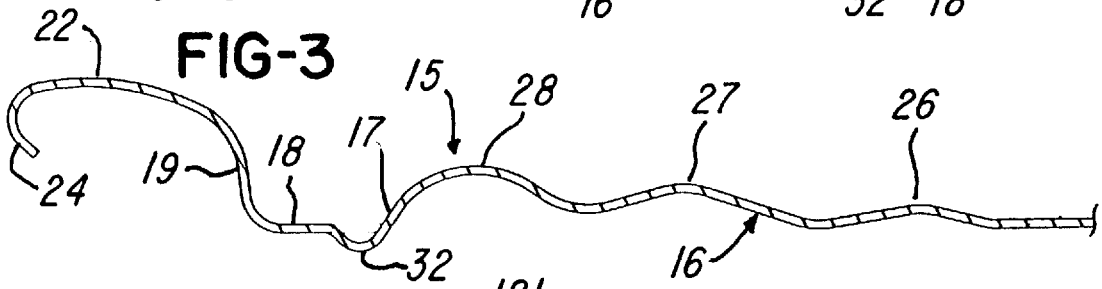
FIG. 3 is a greatly enlarged fragmentary section of the shell shown in FIG. 2.

As shown on FIGS. 2 and 3, the center panel 16 includes a series of concentric ribs or beads 26, 27 and 28 which project upwardly or outwardly of the can, and the bead 28 connects with the annular panel wall 17 which extends around the center panel 16. The can end wall or shell 15, formed in accordance with the invention, also includes an annular bead 32 which projects downwardly or into the container from the countersink wall 18 and integrally connects the panel wall 17 to the countersink wall 18. As apparent from FIG. 3, the bead 32 projects downwardly from a plane defined by the countersink bottom wall 18 and the center portion of the center panel 16. The bead 32 significantly increases the buckle strength of the shell 15 by cooperating with the concentric beads 26–28 and with the countersink wall 18 and chuck wall 19.

Figure 1:
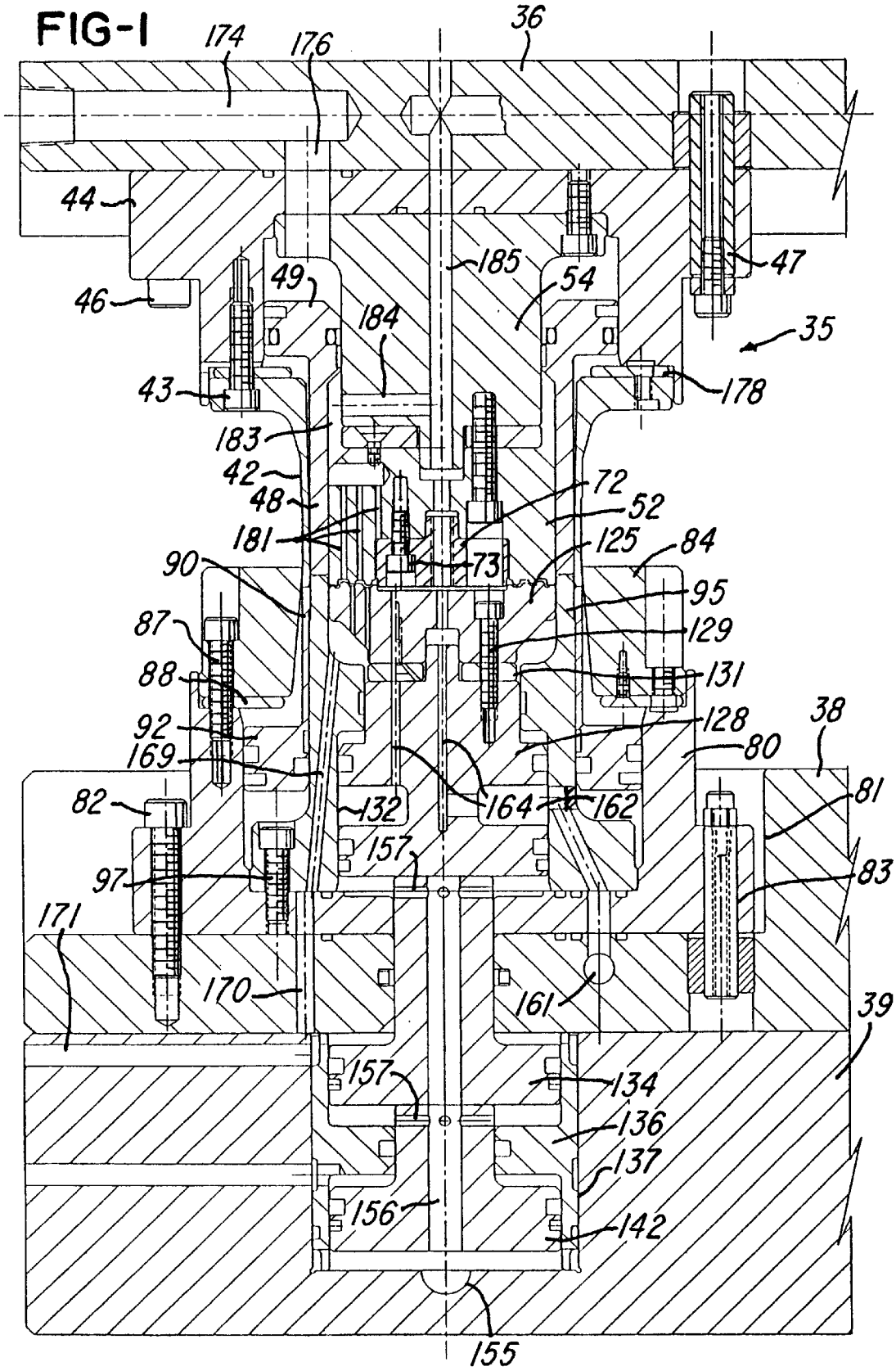
FIG. 1 is an axial section of a typical shell tooling station constructed and operated in accordance with the invention.

Referring to FIG. 1 which shows one of the tooling stations of an eleven out shell forming tooling system or assembly 35, an upper die shoe 36 mounts on the vertically movable platen of a conventional high speed single action or multiple action mechanical press, and a lower die shoe 38 is supported by a bolster or bed plate 39 of the press. An annular blank and draw die 42 has an upper flange portion secured by a series of screws 43 to an inverted cup-shaped retainer 44 which is secured to the upper die shoe 36 by a series of screws 46 and precisely located by locating pins 47. The die 42 surrounds an upper pressure sleeve 48 which has a top piston portion 49 slidably supported within a cylindrical bore formed within the retainer 44.

Figure 4:
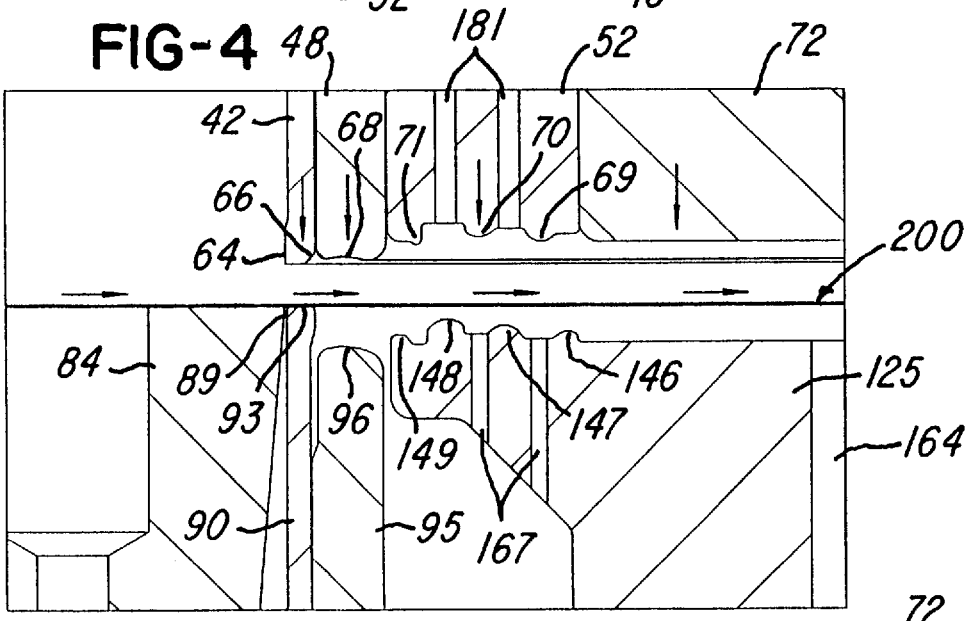
FIGS. 4–14 are enlarged fragmentary block sections of the tooling assembly shown in FIG. 1 and illustrating the progressive steps for producing a shell in accordance with the invention.

An inner die member or die center 52 is supported within the upper pressure sleeve 48 by a die center riser 54 seated within a counterbore within the retainer 44 and secured by a set of screws 56. As shown in FIG. 4, the blank and draw die 42 has a cylindrical lower cutting edge 64 and an inner curved forming surface 66. The lower end of the upper pressure sleeve 48 has a concaved forming surface 68, and the lower end of the die center 52 as a series of downwardly projecting concentric ribs 69, 70 and 71 which surround a die center insert 72 secured to the die center 52 by a set of screws 73 (FIG. 1).

An annular die retainer 80 is mounted on the lower die shoe 38 within a recess 81 and is secured to the lower die shoe 38 by a set of screws 82 and a set of locating pins 83. An annular cut edge die 84 is secured to the retainer 80 by a set of screws 87 extending through an annular spacer plate 88. The cut edge die 84 has an inner circular cutting edge 89 (FIG. 4) with substantially the same diameter as the cutting edge 64 on the blank and draw die 42. An annular lower pressure sleeve 90 has a lower piston portion 92 supported for sliding movement within a cylindrical bore formed within the retainer 80, and the sleeve 90 has an upper surface 93 which opposes the bottom end surface of the blank and draw die 42.

A die core ring 95 is positioned within the lower pressure sleeve 90 and has a rounded upper end surface 96 (FIG. 4) which opposes and mates with the concaved bottom surface 68 of the upper pressure sleeve 48. The die core ring 95 has a lower bottom flange which seats within a counterbore formed within the retainer 80, and a series of screws 97 secured the die core ring 95 so that it is fixed to the lower die shoe 38 and press bed plate 39.

A circular panel punch 125 (FIGS. 1 & 4) is positioned within the die core ring 95 and is secured to a panel punch piston 128 by a set of screws 129 which extend through an annular spacer 131. The panel punch piston 128 slides within a cylindrical bore 132 within the die core ring 95 and rests upon the upper end portion of an auxiliary piston 134. The piston 134 is slidably supported within an annular liner 136 inserted into a cylindrical bore 137 formed within the press bed plate 39. The piston 134 seats on the upper end of another auxiliary piston 142 which is also slidably supported by the liner 136 so that the pistons 128, 134 and 142 all cooperate to force the panel punch 125 upwardly within the die core ring 95 to the home position shown in FIG. 4.

As shown in FIG. 4, the upper end of the panel punch 125 includes a series of upwardly projecting concentric ribs 146, 147, 148 and 149 which cooperate with the ribs 69–71 on the bottom surface of the die center 52 to form the beads 26–28 and 32 within the shell 15. Pressurized air, on the order of 250 psi, is normally applied against the bottom surfaces of the panel punch pistons 128, 134 and 142 by introducing the air through passages 155–157 (FIG. 1). Pressurized air, on the order of 40 psi, is also supplied to the chamber below the piston 92 of the lower pressure sleeve 90 through passages (not shown), and shell lift air is supplied through passages 161 and 162 and an axially extending passage 164 within the center of the piston 128 and the panel punch 125.

Figure 12:
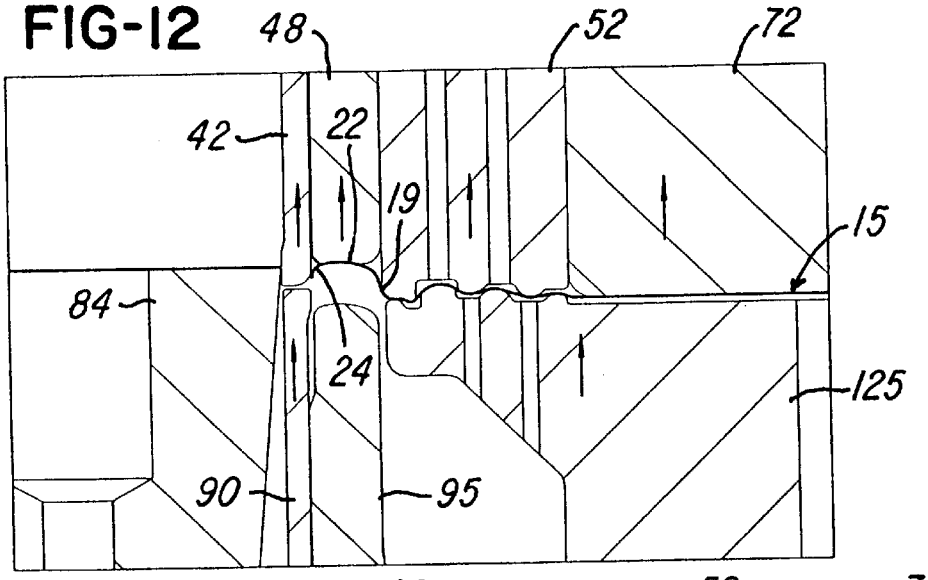
Figure 13:
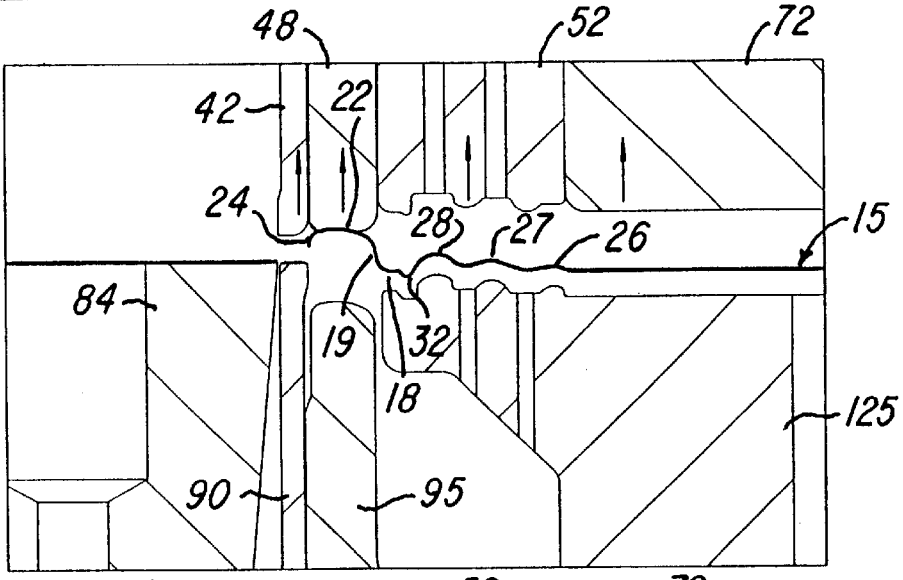

The panel punch 125 also has three peripherally spaced sets of axially extending vent holes or passages 167 (FIG. 4) which extend to the top surface of the panel punch and connect with vent passages 169–171 within the tooling components. Similarly, pressurized air is supplied to the chamber above the piston 49 of the upper pressure sleeve 48 through passages 174 and 176 for urging the upper pressure sleeve 48 downwardly toward a stop provided for an annular wear washer 178. The outer portion of the die center 52 is provided with three peripherally spaced sets of axially extending vent ports or passages 181 which connect with the atmosphere through vent passages 183, 184 and 185. The center vent passage 185 also extends through the insert 72 of the die center 52 in order to release a shell 15 from the bottom surface of the die center 52, as illustrated in FIGS. 12 and 13.

Figure 5:
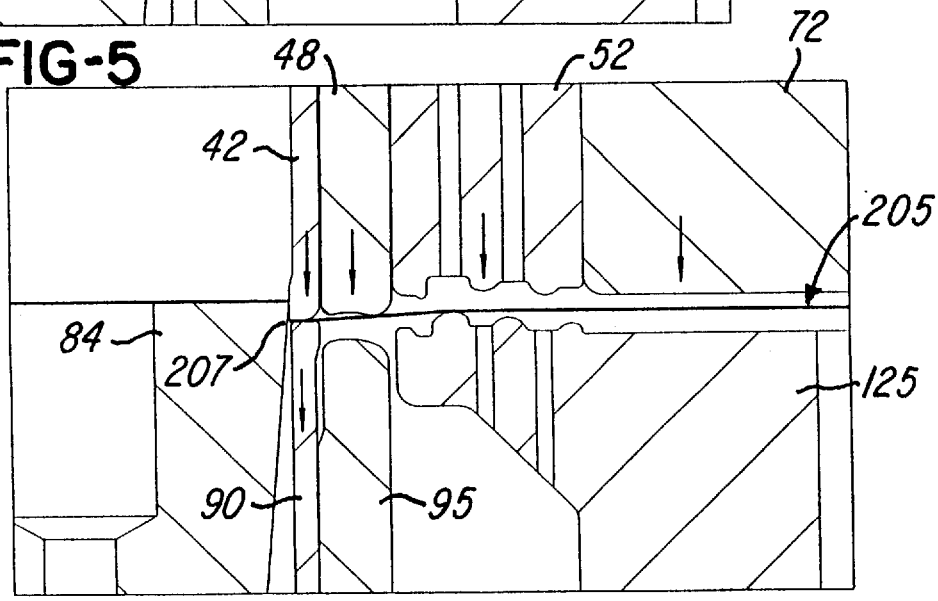
Figure 6:
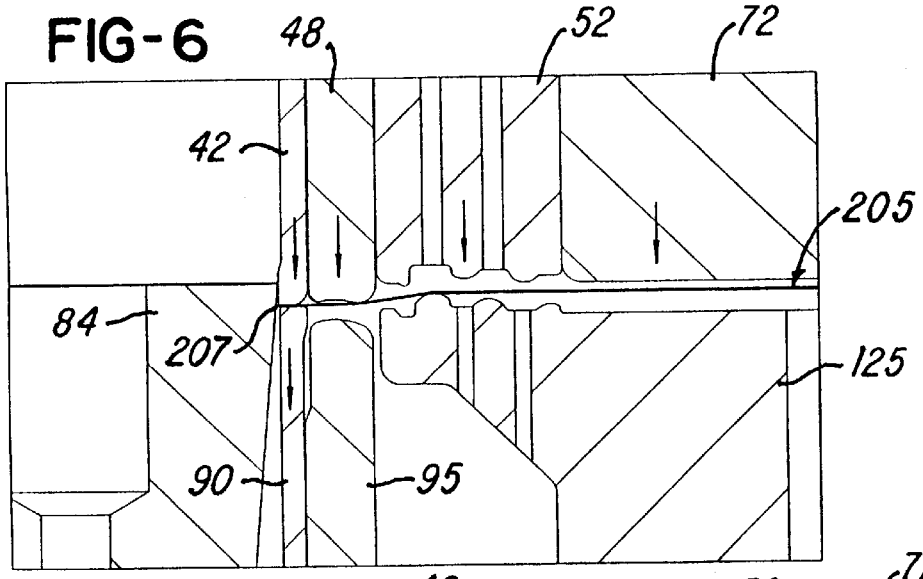
Figure 7:
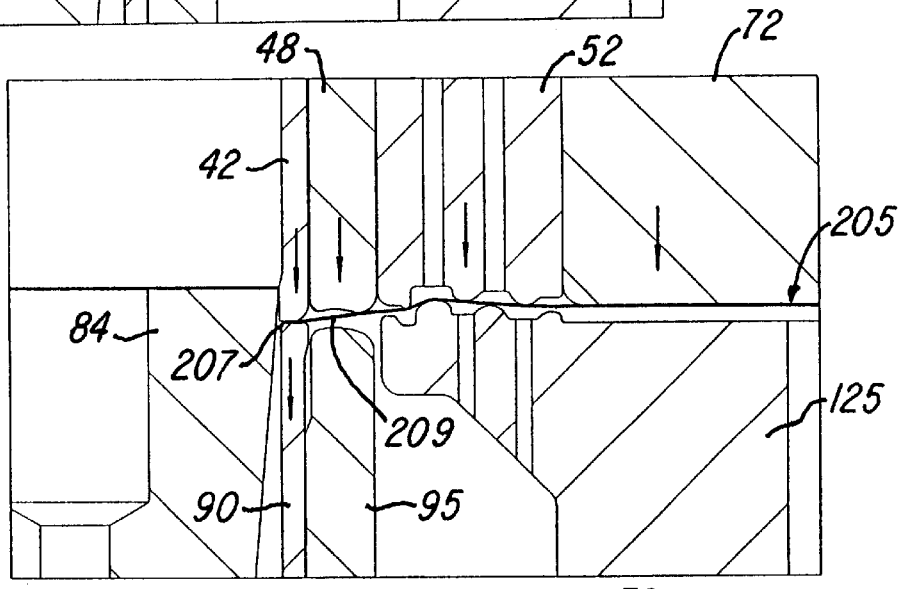
Figure 8:
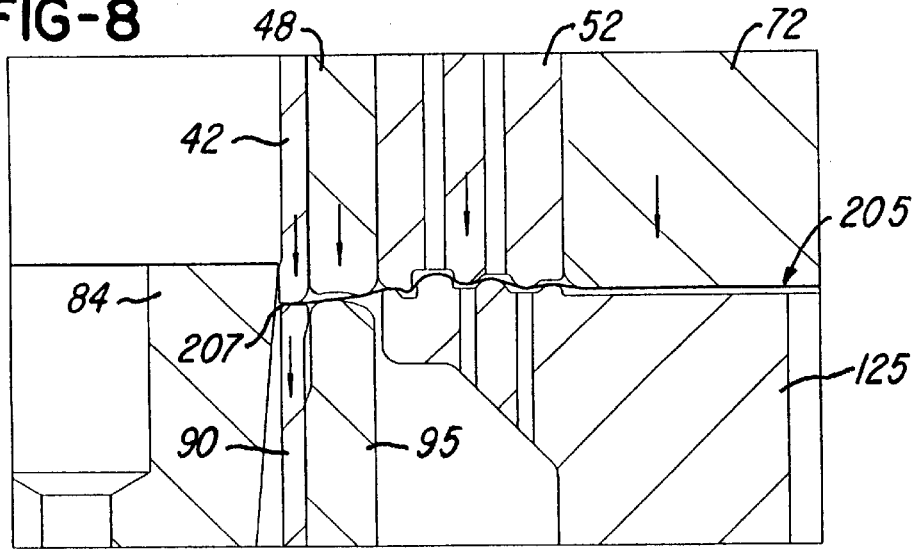

The operation of a tooling system or assembly 35 for successively forming shells with each stroke of the press, is illustrated in FIGS. 4–14. As shown in FIG. 4, a continuous strip or sheet 200 of sheet metal, such as, for example, coated steel sheet having a thickness of 0.006, is fed or advanced across the cut edge die 84 in precise step-by-step increments. When the upper die shoe 36 moves downwardly, the mating shearing edges 64 and 89 blank out a circular disk 205 (FIG. 5). As the blank and draw die 42 and the upper pressure sleeve 48 continue to move downwardly (FIG. 6), a peripheral edge portion 207 of the disk 205 is confined between the die 42 and the upper end of the lower pressure sleeve 90. As the upper pressure sleeve 48 moves downwardly with the blank and draw die 42 (FIG. 7), an annular intermediate portion 209 of the disk 205 tapers upwardly from the peripheral portion 207 while the center panel 16 of the shell, including the beads 26–28 and 32, are formed between the lower surface of the die center 52 and the upper surface of the panel punch 125, as shown in FIGS. 7 and 8.

Figure 9:
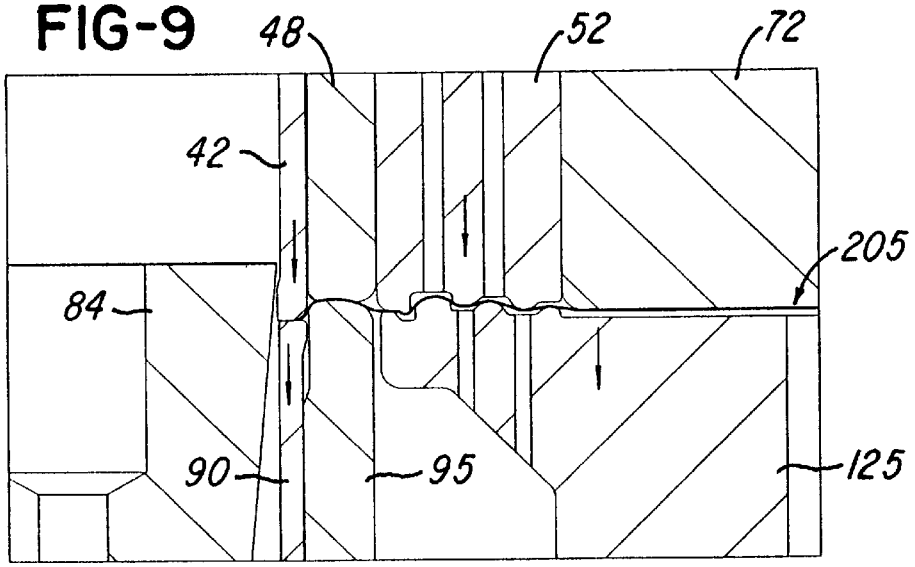
Figure 10:
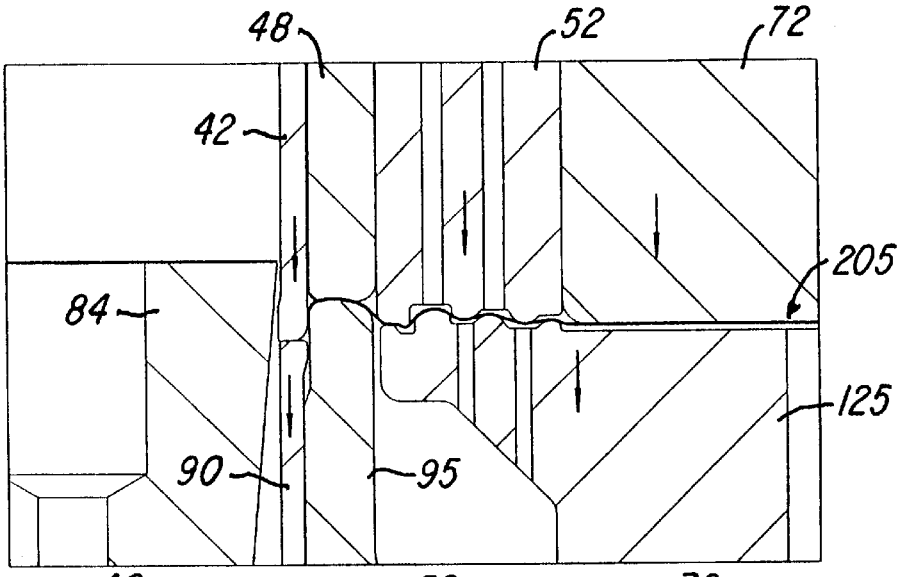
Figure 11:
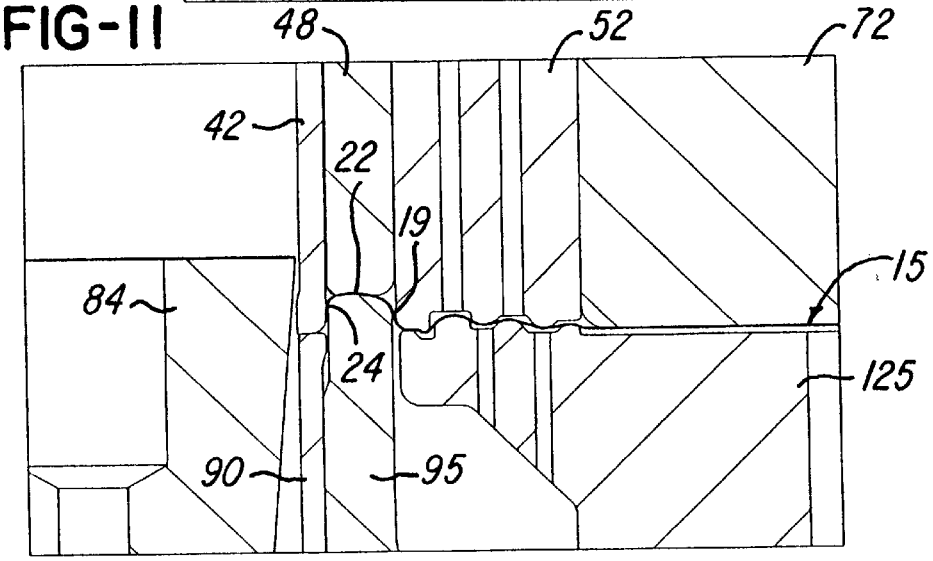
Figure 14:
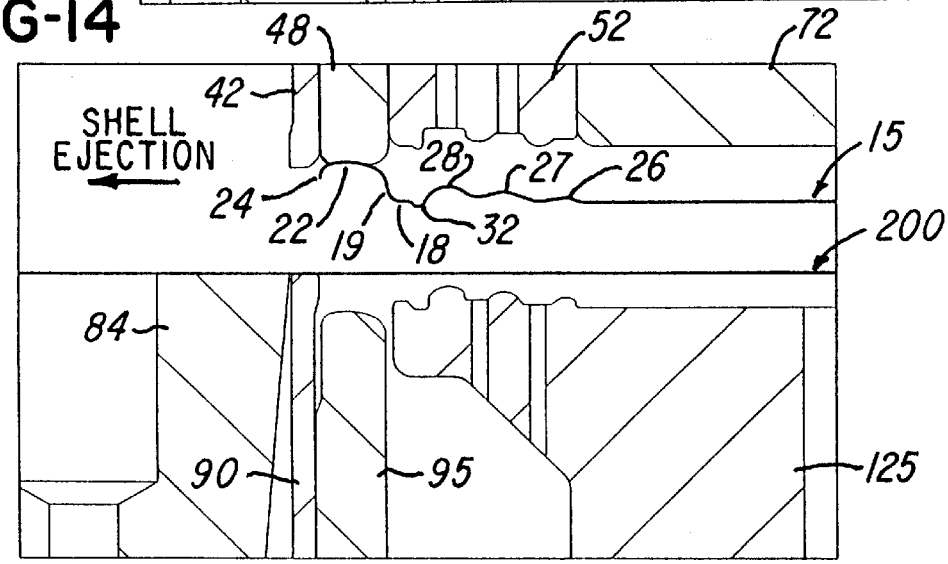

After the beads 26–28 and 32 are formed (FIG. 8), and the die center 52 and center panel punch 125 continue to move downwardly relative to the fixed die core ring 95, as shown in FIGS. 9–11, the chuck wall 19 and the crown portion 22 are formed along with a downwardly projecting peripheral lip 24. Thus at the bottom of the press stroke (FIG. 11), the shell 15 is completed. As shown in FIG. 12, the die center 52, center punch 125, upper pressure sleeve 48, lower pressure sleeve 90 and blank and draw die 42 move upwardly as a unit (FIG. 12) so that the shell is lifted upwardly with the crown portion 22 held in contact with the bottom surface of the upper pressure sleeve 48 by air jets directed upwardly through the passages 164 and around the center panel punch 125, as shown in FIGS. 13 and 14.

After the tooling components have returned to their home positions (FIG. 14), the shell 15 at each tooling station is ejected laterally by a pressurized air jet and into corresponding guide chutes such as disclosed in above-mentioned U.S. Pat. No. 5,491,995. Simultaneously with the ejection of the shells 15, the metal sheet 200 is advanced inwardly by precise predetermined distance so that the next successive batch of shells may be formed, by repeating the operations described above.

The production of can end walls or shells in accordance with the method and tooling of the invention, has been found to provide desirable features and advantages. As a primary feature, by initially forming the concentric beads 26–28 immediately after blanking each disk 205 and at the upper end of the stroke, it has been found the beads 26–28 are formed without significantly thinning the sheet metal in the area of the beads, resulting in increased buckle strength of the shell. As a result, the gage or thickness of the coated steel sheet 200 may be reduced, for example from 0.008 inch to 0.006 inch, resulting in a significant cost savings in view of the high volume of sheet metal shells produced each year. In addition, the downwardly or inwardly projecting bead 32 on the shell 15 further contributes to increasing the buckle strength of the shell and to the reduction in the sheet metal gage or thickness. Also, the initial forming of the beads 26–28 and 32 decreases the disruption of the protective lacquer or laminate on the inner surface of the shell. Furthermore, the tooling at each station, as shown in FIG. 1, may also be operated at a high speed, for example, over 250 strokes per minute, and the arrangement of the pistons 128, 134 and 142 are effective to produce the necessary upward force on the panel punch 125 to form the beads 26–28 and 32 at the upper end of the stroke, while minimizing the required air pressure behind the pistons.

While the method and form of apparatus herein described constitutes a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

I claim:

1. A method of producing a container end wall or shell from a flat metal sheet, the shell including a center panel having concentric annular beads and connected by an annular panel wall portion to an annular countersink portion which is connected to an annular crown portion by an annular chuck wall portion, the method comprising the steps of blanking a disk from the metal sheet, gripping a peripheral portion of the disk, forming the center panel including the concentric beads within the disk, and thereafter forming the chuck wall portion within the disk.

2. A method as defined in claim 1 including the step of forming the countersink portion with an annular bottom wall, and forming an annular countersink bead adapted to project inwardly into the container from the countersink bottom wall.

3. A method as defined in claim 1 wherein the concentric beads and the panel wall portion of the center panel are formed while the center panel is surrounded by a tapered inverted annular wall portion, and thereafter forming the inverted annular wall into the chuck wall portion.

4. A method of producing a container end wall or shell from a flat metal sheet, the shell including a center panel having concentric annular beads and connected by an annular panel wall portion to an annular countersink portion which is connected to an annular crown portion by an annular chuck wall portion, the method comprising the steps of blanking a disk from the metal sheet, gripping a peripheral portion of the disk, forming the center panel including the concentric beads within the disk, forming the countersink portion with an annular bottom wall, forming an annular countersink bead adapted to project inwardly into the container from the countersink bottom wall, forming the chuck wall portion within the disk, and wherein the countersink portion and the chuck wall portion are formed within the disk after forming the concentric beads within the disk.

5. A method as defined in claim 4 wherein the concentric beads and the panel wall portion of the center panel are formed while the center panel is surrounded by a tapered inverted annular wall, and thereafter forming the inverted annular wall into the countersink portion and the chuck wall portion.

6. A method of producing a container end wall or shell from a flat metal sheet, the shell including a center panel having concentric annular beads and connected by an annular panel wall portion to an annular countersink portion which is connected to an annular crown portion by an annular chuck wall portion, the method comprising the steps of blanking a disk from the metal sheet, gripping a peripheral portion of the disk between a blank die and an opposing pressure sleeve, forming the center panel with the concentric annular beads within the center portion of the disk by moving a die center having concentric annular ribs against a panel punch having concentric annular ribs, and thereafter moving the center panel with the die center and panel punch axially relative to peripheral portion being gripped between the blank die and pressure sleeve to form the chuck wall portion within the disk.

7. A method as defined in claim 6 and including the steps of pressurizing the panel punch with a plurality of axially spaced air actuated pistons to assist in forming the concentric beads within the center portion of the disk prior to forming the chuck wall portion.

8. A tooling system for forming a container end wall or shell from a flat metal sheet and adapted for use in a single action press, the shell including a center panel having concentric annular beads and connected by an annular panel wall portion to an annular countersink portion which is connected to an annular crown portion by an annular chuck wall portion, said tooling system comprising an annular blank die and an opposing annular first pressure sleeve supported for blanking a disk from the sheet, an annular second pressure sleeve within said blank die and an opposing annular die core ring within said first pressure sleeve, a die center disposed within said second pressure sleeve and an opposing panel punch disposed within said die core ring, said die center having an end surface with a plurality of concentric annular ribs, said panel punch having an end surface opposing said end surface of said die center and having a plurality of concentric annular ribs, and means for moving said blank die and said first pressure sleeve axially relative to said panel punch for first moving a peripheral portion of the disk axially to form the center panel with the concentric annular beads between said ribs of said die center and said ribs of said panel punch and thereafter moving the center panel axially with said die center and said panel punch relative to the peripheral portion of the disk to form the chuck wall portion and the crown portion adjacent said second pressure sleeve and said die core ring.

9. A tooling system as defined in claim 8 and including a plurality of air-actuated pistons positioned to urge said panel punch against said die center with sufficient force to form the concentric beads at the start of the press stroke.

10. A tooling system as defined in claim 8 wherein one of said annular ribs on said die center projects axially beyond the adjacent said rib on said die center and cooperates with said ribs on said panel punch to form an annular bead projecting, inwardly into the container from said annular countersink portion of the shell.

* * * * *